US005656984A

United States Patent [19]

Paradis et al.

[11] Patent Number: 5,656,984

[45] Date of Patent: Aug. 12, 1997

[54] SOLID INSULATION TRANSFORMER

[75] Inventors: Claude Paradis, St. Luc; Marcel Fortin, Julie, both of Canada; Michael Edward Haas, York Town, Va.; Thomas J. Lanoue, Cary, N.C.; Jean-Guy Pineault, Longueuil, Canada; Robert Guillemette, Belleville, Canada; Mohammed Chaaban, St-Hubert, Canada

[73] Assignee: Centre D'Innovation Sur Le Transport D'Energie Du Quebec, Quebec, Canada

[21] Appl. No.: 417,906

[22] Filed: Apr. 6, 1995

[51] Int. Cl.[6] ..... H01F 27/08; H01F 27/02

[52] U.S. Cl. ..... 336/61; 336/96

[58] Field of Search ..... 336/60, 61, 96

[56] References Cited

U.S. PATENT DOCUMENTS 4,523,171 6/1985 Altmann et al. ..... 336/96

*Primary Examiner*—Michael L. Gellner

*Assistant Examiner*—Daniel Chapik

*Attorney, Agent, or Firm*—Burns, Doane, Swecker & Mathis, L.L.P.

[57] ABSTRACT

The solid insulation transformer has a rectangular core covered with a compressible closed-cell foam to eliminate stress during curing of the cast dielectric material surrounding the core and during operation. Heat pipes are placed between the inner coil and the core to extract heat before the temperature builds up. For safety and to eliminate the need for a separate enclosure, an outer multi-layer casing having an incorporated grounded conductive layer is provided to cover the sides of the cast body. The outer casing prevents explosion if dielectric break down and arcing occur, and reduces the danger of electric shock.

24 Claims, 4 Drawing Sheets

24

22
22
21
18
16
12
14
10
50
34
20

SOLID INSULATION TRANSFORMER

FIELD OF THE INVENTION

The present invention relates to a solid or dry transformer, i.e. a transformer in which the dielectric insulation is a solid instead of a liquid, e.g. oil, or gas, e.g. circulated air. The invention relates further to a solid or dry distribution transformer.

BACKGROUND OF THE INVENTION

It is known in the art to mount a transformer core along with the primary and secondary coils in a solid cast material to obtain a "dry" transformer, i.e. without using a dielectric liquid or gas to dissipate the heat generated in the coils and in the transformer core. Success in making such solid or dry transformers has only been found to a limited extent in relatively low power transformers.

Some of the difficulties encountered will be briefly discussed in the following. Heat dissipation through a solid dielectric material is known to be poor and the result of thermal build-up can create hot spots or high thermal gradients which can crack the solid dielectric material. The resulting fissure or fissures can be dangerous because of mechanical instability (the transformer body can break apart), and a break-down in the dielectric medium between the coils, and the core or ground.

Furthermore, if arcing occurs within the solid insulation, vaporization of the solid material can build up gas pressure which can even lead to fragmentation of the solid material and explosion.

Conventional dry-type transformers require a grounded enclosure to remove any electrical shock hazard. Such enclosures are typically metal cages having dimensions much larger than the transformer itself, making installation space requirements difficult.

Another problem in constructing a solid or dry transformer is that the expansion and contraction of the core as a result of temperature variations and shrinking of the cast solid insulation material induces stresses on the cast transformer body.

A further difficulty in manufacturing a large scale transformer, such as a distribution transformer, having a surrounding dielectric cast material lies in curing or setting the cast material in an even and homogeneous way to provide for homogeneous physical properties throughout the solid cast body.

SUMMARY OF THE INVENTION

It is an object of the present invention to provide a solid transformer which overcomes the known difficulties of solid or dry transformer construction and manufacture. In particular, it is an object of the present invention to provide a safe and functional solid distribution transformer. It is a further object of the present invention to provide a solid insulation distribution transformer that can be installed in conditions where the transformer may be partially or fully submerged in water, such as in an underground power distribution vault.

According to the invention, there is provided a solid insulation transformer comprising a core, a primary coil and a secondary coil wound around at least one limb of the core, a solid cast dielectric material filling a space between the primary coil, the secondary coil and the core, and a compressible sheet material provided between the core and the cast dielectric material. In this way, relative movement between the core and the cast material is substantially absorbed by the compressible material. Thermal expansions and contractions of the core are also absorbed by the compressible material. The compressible sheet material is preferably resilient. For example, a closed cell temperature resistant foamed rubber or silicone material is suitable. When seams of the compressible sheet material need to be joined, a silicone sealant which is non-corrosive is preferably used, i.e. silicone sealant which releases acetic acid during curing is not recommended since the acetic acid can corrode the core.

According to the invention, there is also provided a solid transformer comprising a core, a primary coil and a secondary coil wound around at least one limb of the core, a solid cast dielectric material filling a space between the primary coil, the secondary coil and the core, an outer casing covering at least a lateral exterior surface of the cast material and incorporating a grounded conductive layer. In this way, the casing contains the cast material in case the cast material cracks as a result of thermal stress or arcing, and the grounded conductive layer prevents an electric shock hazard on an exterior of the transformer. Preferably, the outer casing is made from pieces of preformed multi-layer fiber reinforced material and resin, the resin preferably not including any filler. Carbon fiber is included or incorporated inside the shell components, and the carbon fiber material is a relatively good conductor- The shell components of the outer casing are preferably bonded together and provide a tough outer shell. The multi-layer fiber-reinforced material preferably absorbs the energy of a crack or fissure in the cast material by deforming and undergoing layer separation locally while preventing solid fragments from escaping. This preferred construction provides what is known as a ballistic quality to the outer casing.

According to the invention, there is also provided a solid transformer comprising a core, a primary coil and a secondary coil wound around at least one limb of the core, heat exchange means provided between at least one of the coils and the core for conducting heat to an outside of the transformer, and a solid cast dielectric material filling a space between the primary coil, the secondary coil and the core. Advantageously, when the coils are concentrically wound for good electromagnetic coupling, the heat from the outer coil is dissipated through the surrounding cast material to the ambient air and the heat from the inner coil and core is dissipated by the heat exchange means. Furthermore, the heat exchange means preferably comprise a copper or other good thermal conductor heat pipe system which, by being placed between the coil and the core instead of between the concentric coils, does not adversely affect the dielectric medium between the coils. Preferably, the heat exchange means comprise at least one heat pipe. Heat pipes are known in the art.

In the present specification, the reference to "concentric" simply means contained within the perimeter of one another, it being acknowledged that the core does not have to be circular and is most likely to be of a rectangular cross-section and thus the coils will not have a circular cross-section in most cases.

In the present invention, the cast dielectric material fills a space between the primary and secondary coils in order to insulate one from the other. As a result, a mechanical support of the coils and the core is provided by the cast dielectric material, although such support is initially provided by other means until the casting is complete.

In the present invention, it is important that at least the primary and secondary coils in their entirety and at least part of the core be encased in the cast dielectric material (as required to provide good electrical insulation). Preferably, the entire core as well as the coils are submerged in the dielectric material as a liquid which is then cured to become a solid. Similarly, the entire core is preferably covered with the resilient compressible material to allow for expansion and contraction of the core during curing and operation.

BRIEF DESCRIPTION OF THE DRAWINGS

Other objects and features of the present invention will be better understood by way of the following detailed description of a preferred embodiment with reference to the appended drawings in which.

DETAILED DESCRIPTION OF THE PREFERRED EMBODIMENT

Figure 1:
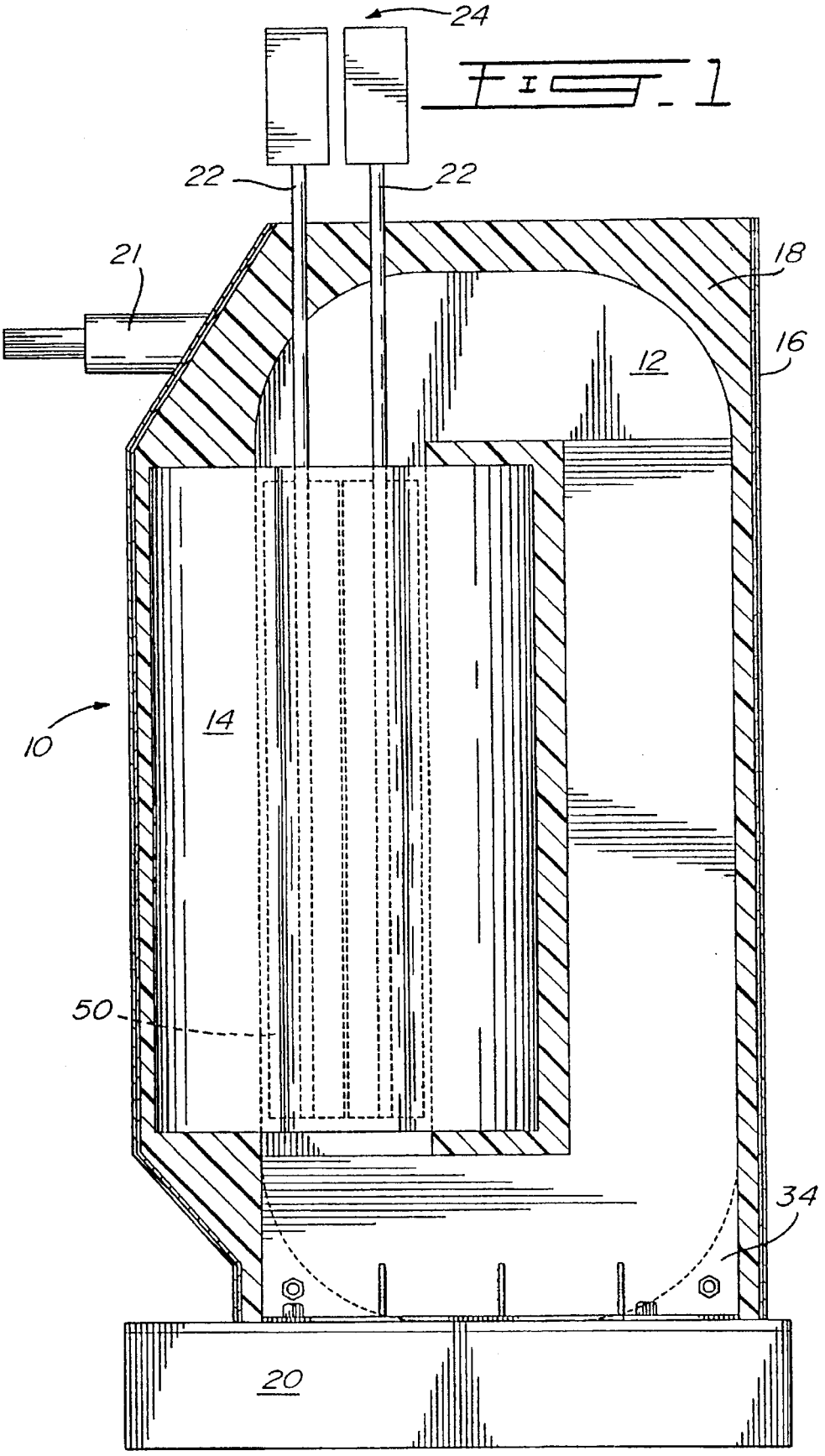
FIG. 1 is a side cross-sectional view of the molded solid transformer according to the preferred embodiment.

FIG. 1 illustrates the basic construction of the solid insulation distribution transformer according to the preferred embodiment. The transformer 10 has a core 12 and coils or windings 14. An outer casing 16 surrounds a molded mass 18. The molded mass 18 is a dielectric resin which completely encases and surrounds the core 12 and the windings 14. A bracket (not shown) connected to the core exterior side casing 34 supports the windings 14. The high voltage and the low voltage terminals are provided at the front on connectors as shown at 21. Heat generated by the core 12 and the windings 14 is extracted by four heat pipes 22 each having conductive heat sink blades 50 for collecting heat in the region between the core 12 and the windings 14 to draw the heat up towards radiators 24. The distribution transformer 10 is mounted on a base 20, the base being engageable by a forklift for ease of manipulation.

Figure 2:
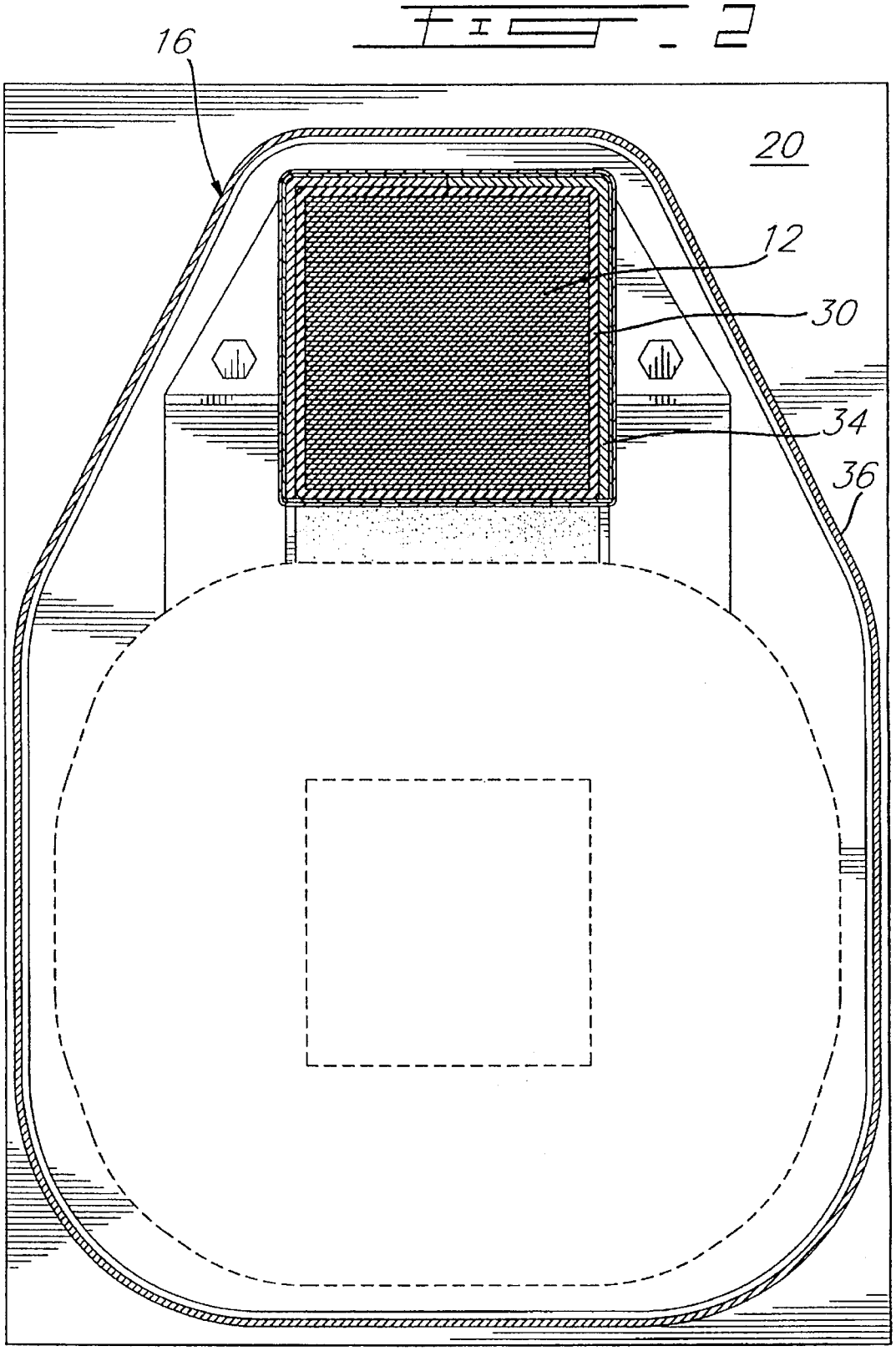
FIG. 2 is a horizontal cross-section of the solid transformer illustrated in FIG. 1.
Figure 3:
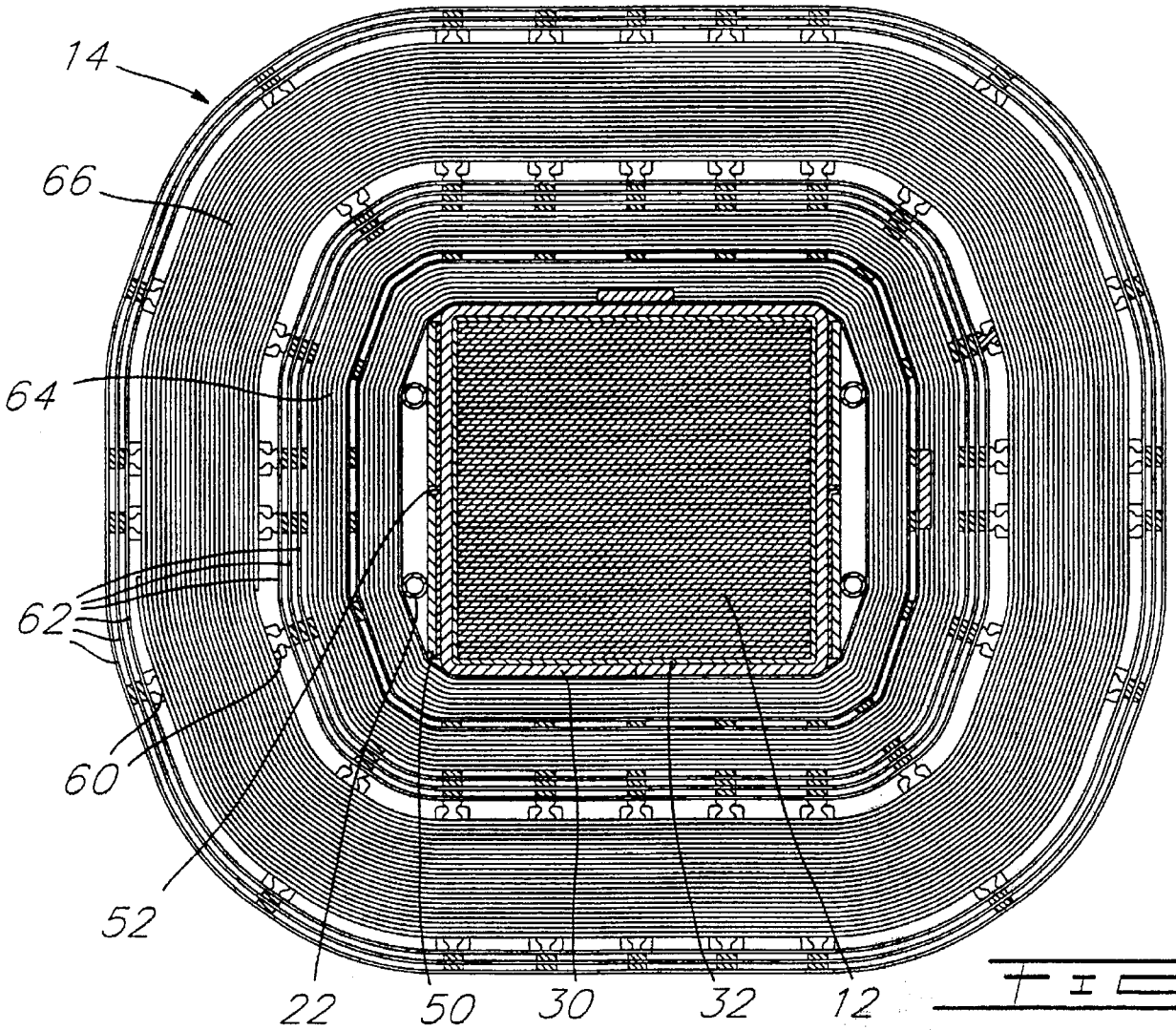
FIG. 3 is a detailed cross-section of the way in which the core and coils are assembled according to the preferred embodiment.

According to a first aspect of the present invention, as shown in FIGS. 2 and 3, the magnetic core is not directly cast in the solid dielectric material 18 but rather it is surrounded by a resilient and compressible sheet material 30. During curing of the cast material 18, the compressible sheet material 30 is constricted as the cast material shrinks. The core is thus also allowed to vibrate and to undergo thermal expansion and contraction without breaking away from the solid cast material 18. A silicone foam rubber (closed cell) sheet material 30 is wrapped around all of the core 12. Silicone sealant is used to close together and render resin-tight the compressible sheet material 30 at the seam or seams thereof. The laminated core 12 thus does not soak up the liquid cast dielectric material 18 during molding. The silicone sealant used to seal up the sheet material 30 is preferably the kind which does not release acetic acid during curing to avoid subjecting the laminated core 12 to the acetic acid. As illustrated in FIG. 2, the resilient foam sheet material 30 is partly surrounded by steel casing plates 34 on its outer sides at the base and free elongated limb by which the whole of the core 12 and coils 14 is supported when mounted to base 20. The casing plates 34 may be made of metal of composite material.

Furthermore, in accordance with the present invention, any possible cracks due to thermal build-up in the mass of molded dielectric material 18 surrounding the core 12 are prevented from propagating radially by a series of concentric dielectric sheets 62 placed between the primary coil 66 and the secondary coil 64, as well as between the secondary coil 64 and the grounded outer casing 16. While these sheets 62 are shown to be concentric square-shaped tubes, it would, of course, be possible to provide a spiral of a continuous sheet in order to place a plurality of sheets between the primary and secondary coils. The molded dielectric material 18 fills the spacing between the sheets 62. The sheets 62 (e.g. NOMEX™ paper which is a synthetic fiber paper-like web material having good dielectric properties as well as good physical strength and flexibility when provided in a thickness not much thicker than standard bond paper) are held in place by spacers generally indicated by reference numeral 60. The spacers 60 may be made of fiberglass strips or the like.

According to a second aspect of the present invention, the heat pipes 22 as illustrated in FIGS. 1 and 3, are arranged to extract heat from the core 2 and the secondary low voltage windings 64. Heat pipes, well known in the art, are heat transfer devices consisting of a sealed metal tube with an inner lining of wicklike capillary material and a small amount of fluid in a partial vacuum, in which heat is absorbed at one end by vaporization of the fluid and is released at the other end by condensation of the vapor. Heat absorbed by the pipes 22 within the distribution transformer 10 causes the liquid contained within the wick structure to evaporate. The vapor in the center of the heat pipes 22 moves through the wick-like coating in the radiator end of the pipes 22 to condense and release heat to the radiator fins 24. The wick-like coating transports the liquid by capillary action from the condenser section outside the transformer to the evaporator section inside the transformer where the heat is generated. The blades 50 help collect the heat from within the transformer for transport by the heat pipes 22. An insulator strip 52 (e.g. a NOMEX strip) is used to separate the two sets of blades 50 in order to electrically insulate the two and prevent a current loop.

As can be seen in FIG. 3, the heat pipes are arranged on the outside of the silicone sheet material 30. Heat is more readily absorbed in this way from the low voltage windings 64. Heat which builds up in the core 12 is collected by the heat pipes as it passes through the sheet material 30. The heat generated by the outer high voltage windings 66 is dissipated through the cast dielectric 18 to the outer casing 16 and to the ambient air. In the preferred embodiment, two heat pipes 22 are provided on each lateral side of the core 12. This has proven to be efficient for removing the heat that is generated in the case of a 167 kVA distribution transformer. 0f course, it would be possible to have a heat pipe inside the sheet material 30. While heat pipes are preferred because they are passive and maintenance-free, active fluid circulation heat exchange apparatus could also be implemented.

Figure 4:
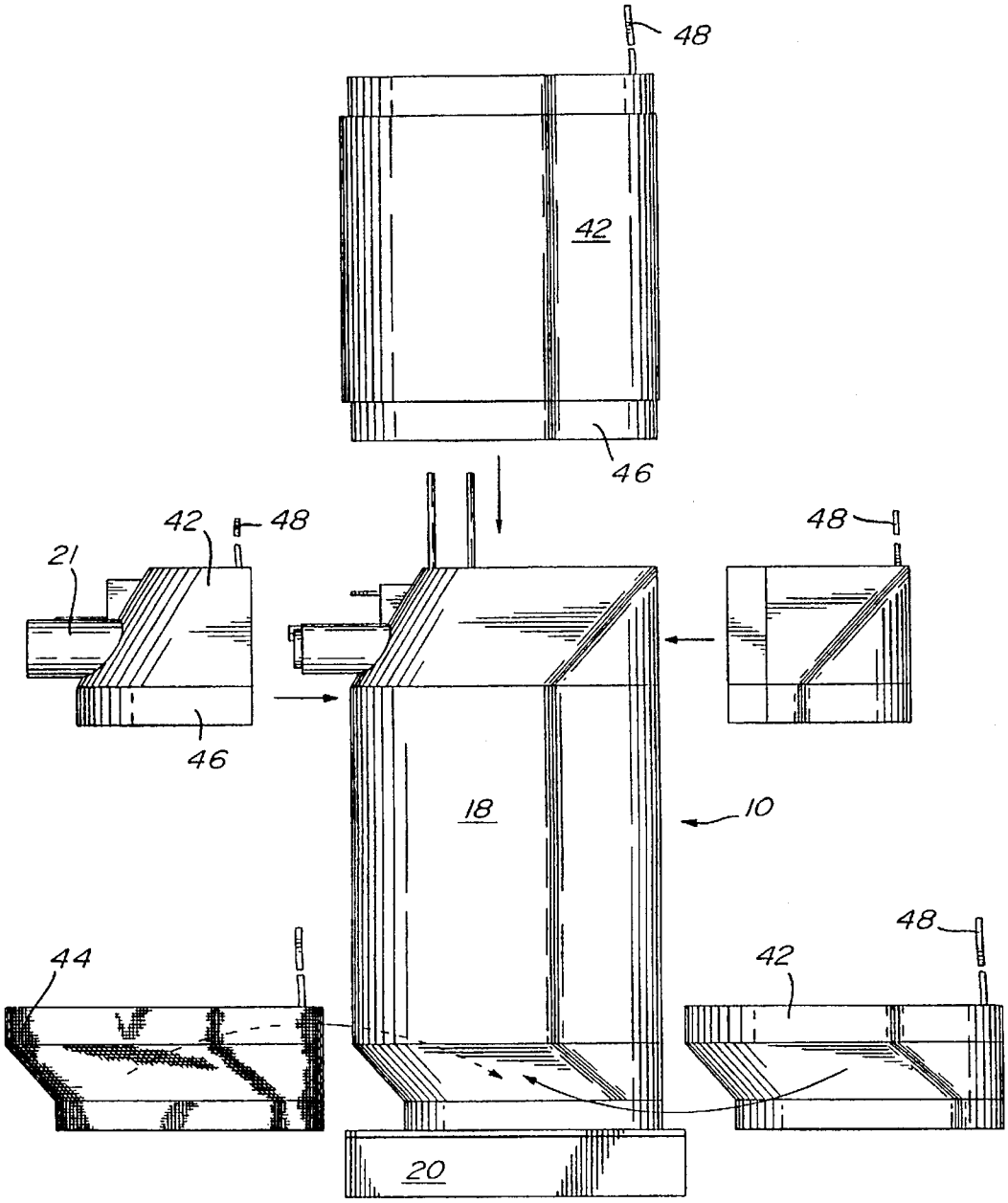
FIG. 4 illustrates the molded transformer with its outer casing members before assembly according to the preferred embodiment.

With reference to FIGS. 1 and 4, an aspect of the present invention will be described. The outer casing 16 which surrounds the solid body 18 comprises an outer multi-layer fiberglass shell 42 with an inner carbon fiber cloth liner 44. The shell members comprise interlocking tabs 46 which allow the fiberglass shell members to be glued together to form a rigid and solid shell completely surrounding the sides of the distribution transformer 10. As illustrated, thin copper strips 48 are connected to the cloth liner 44 in order to connect the cloth to ground. By grounding the carbon fiber cloth liner 44, electric fields within the distribution transformer 10 which emanate from the windings 14 will not result in a shock hazard to workers coming into contact with the casing 16.

By providing a fiberglass shell to cover the molded dielectric body 18, a very safe structure is constructed. Thus, if a pressure build-up inside of the molded body occurs resulting in the body 18 wanting to crack apart under the gas pressure, the fissure will travel until it reaches the casing 16, at which point its energy will be absorbed. The built-up gas pressure can then travel upwards towards the top of the transformer 10 where the casing 16 is not provided and be safely released there. This construction is known as a "ballistic armor" construction since it prevents any harmful effects from an otherwise explosive condition. The tapering at the top of the transformer both reduces the volume of the cast dielectric and increases the effectiveness of the casing 16 by reducing the exposed surface. It is assumed that the exposed surface points in a direction free from the usual passage of workers.

The cast insulating material 18 may be made from a resin-filler mixture, such as the Ciba-Geigy resin sold under the name "Araldite CW229" mixed with a Wollastenite powder filler ($CaSi0_3$). The filler upgrades the resin structural properties. The dilation coefficient of the set resin-filler composite is also close to that of steel. After the shell members 42 are assembled together to make the casing 16, the steel molds are then applied to the casing 16 before the resin filler mixture is vacuum cast in the casing 16 and allowed to fully cure. The copper strips 48 are then connected to a ground terminal to ground the carbon fiber cloth material contained in the shell members 42.

We claim:

1. A solid insulation transformer comprising:

a core;

a primary coil and a secondary coil wound around at least one limb of said core;

a solid cast dielectric material filling a space between said primary coil, said secondary coil and said core; and a compressible sheet material provided between said core and said cast dielectric material;

whereby relative movement between said core and said cast material is substantially absorbed by said compressible material.

2. The transformer as defined in claim 1, wherein said compressible sheet material covers an entire surface of said core and seals said core from said cast material.

3. The transformer as defined in claim 2, wherein a rigid support member is provided to support said compressible sheet material at least at an underside of said core, said rigid support member being connected to a base of said transformer, whereby said compressible sheet material is substantially evenly compressed when supporting a weight of said core before said cast material is solid.

4. A transformer as claimed in claim 1, further comprising heat exchange means provided between at least one of said coils and said core for conducting heat from said at least one coil and said core to an outside of said transformer.

5. A transformer as claimed in claim 1, further comprising an outer casing covering at least a lateral exterior surface of said cast material and incorporating a grounded conductive layer, said cast material encasing all of said core and said coils, said sheet material covering all of said core.

6. A transformer as claimed in claim 1, wherein said compressible sheet material is a resilient closed cell foam material.

7. A transformer as claimed in claim 2, wherein said compressible sheet material is a resilient closed cell foam material.

8. A transformer as claimed in claim 7, wherein said core is rectangularly shaped, and said coils are wound concentrically around one elongated limb of said core.

9. A solid transformer comprising:

a core;

a primary coil and a secondary coil wound around at least one limb of said core;

a solid cast dielectric material filling a space between said primary coil, said secondary coil and said core;

an outer casing covering at least a lateral exterior surface of said cast material and incorporating a grounded conductive layer, whereby said casing contains said cast material in case said cast material cracks as a result of thermal stress or arcing, and said grounded conductive layer prevents an electric shock hazard on an exterior of said transformer.

10. The transformer as claimed in claim 9, wherein said casing comprises an upwardly tapered upper portion and a downwardly tapering lower portion, said outer casing not covering an upper and lower extremity of said dielectric material.

11. A solid transformer as claimed in claim 9, wherein said grounded conductive layer comprises a carbon fiber material.

12. A transformer as claimed in claim 9, wherein said outer casing comprises a plurality of multi-layer fiber reinforced shell members having overlapping engaging tab portions and including a grounded carbon fiber conductive layer, said shell members being cemented together and to said dielectric material.

13. A transformer as claimed in claim 9, wherein said core is rectangularly shaped, and said coils are wound concentrically around one elongated limb of said core.

14. A transformer as claimed in claim 9, wherein a compressible sheet material is provided between said core and said cast dielectric material, whereby relative movement between said core and said cast material is substantially absorbed by said compressible material.

15. A transformer as claimed in claim 9, further comprising heat exchange means provided between at least one of said coils and said core for conducting heat from said at least one coil and said core to an outside of said transformer.

16. A solid transformer comprising:

a core;

a primary coil and a secondary coil wound around at least one limb of said core;

heat exchange means provided between at least one of said coils and said core for conducting heat to an outside of said transformer; and a solid cast dielectric material filling a space between said primary coil, said secondary coil and said core.

17. A transformer as claimed in claim 16, wherein said core is a closed rectangular loop, said primary coil and said secondary coil are concentrically wound around a same limb of said core.

18. A transformer as claimed in claim 16, wherein said heat exchange means comprise at least one heat pipe.

19. A transformer as claimed in claim 18, wherein said core is a closed rectangular loop, and at least one said heat pipe is provided on each side of said core, each said heat pipe having a thermally conductive blade member for transporting heat from said core side and an adjacent one of said coils.

20. A transformer as claimed in claim 19, wherein at least two said heat pipes are provided on each side, adjacent ones of said blade members being separated by electrically insulating means.

21. A transformer as claimed in claim 16, wherein a compressible sheet material is provided between said core and said cast material, said heat exchange means being provided between said compressible sheet material and said one of said coils.

22. A transformer as claimed in claim 17, wherein said transformer is a distribution transformer, and said secondary coil is inset within said primary coil, said heat exchange means removing heat from said limb and said secondary coil.

23. A solid transformer as claimed in claim 22, further comprising a compressible sheet material provided between said core and said cast dielectric material.

24. A transformer as claimed in claim 23, further comprising an outer casing covering at least a lateral exterior surface of said cast dielectric material and incorporating a grounded conductive layer.

* * * * *